United States Patent [19]

Greene et al.

[11] 4,306,363

[45] Dec. 22, 1981

[54] SIDE CUTTER APPARATUS FOR AN EXCAVATING MACHINE

[75] Inventors: George O. Greene; Mark A. Morgan; Brian G. Anderson, all of Tulsa, Okla.

[73] Assignee: Unit Rig & Equipment Co., Tulsa, Okla.

[21] Appl. No.: 141,283

[22] Filed: Apr. 18, 1980

[51] Int. Cl.[3] ..... E02F 5/02

[52] U.S. Cl. ..... 37/80 A; 37/189; 37/DIG. 16

[58] Field of Search ..... 37/80 R, 80 A, 83, 85, 37/91, 94, 189, 190, 191 R, 191 A, DIG. 16, 141 R, 141 T

[56] References Cited

U.S. PATENT DOCUMENTS

| | | | |
|---|---|---|---|
| 824,839 | 7/1906 | Bentson | 37/80 A |
| 1,455,206 | 5/1923 | Howe et al. | 37/80 A |
| 2,602,410 | 7/1952 | Vaughn | 37/80 A |
| 3,783,537 | 1/1974 | Penote | 37/94 |
| 3,896,571 | 7/1975 | Satterwhite | 37/190 |
| 4,074,447 | 2/1978 | Shivers et al. | 37/94 X |
| 4,216,832 | 8/1980 | Stephenson et al. | 37/94 X |

FOREIGN PATENT DOCUMENTS

| | | | |
|---|---|---|---|
| 39301 | 7/1946 | Australia | 37/94 |

*Primary Examiner*—E. H. Eickholt

*Attorney, Agent, or Firm*—William S. Dorman

[57] ABSTRACT

A side cutter apparatus for an excavating machine having a plurality of spaced rotating digging wheels mounted on a common horizontal shaft, each wheel having a pair of spaced sidewalls, and having frame rails partially extending into the spaces between adjacent wheels; which includes a base plate affixed to the periphery of a cut-away section of a sidewall adjacent to the open space between the wheels; a pivotal side cutter including a back panel disposed in the cut-away section and pivotally mounted at its lower end on the base plate so as to pivot into the open space, a front panel disposed essentially parallel to the back panel and pivotally mounted at its lower end on a common axis with the back panel so as to be pivotally movable therewith, a cutting tooth affixed to the upper portion of the front panel and extending into the open space, a roller rotatably mounted on an axis perpendicular to the front panel and extending through the same into a vertical space between the panels wherein the roller is directly adjacent to the open space between the wheels; a spring for urging the side cutter into the open space; a stop for limiting the pivotal movement of the side cutter, a cam for moving the side cutter into a closed position against the action of the spring, and a track for maintaining the side cutter in the closed position during a predetermined portion of the wheel's rotation.

8 Claims, 9 Drawing Figures

SIDE CUTTER APPARATUS FOR AN EXCAVATING MACHINE

BACKGROUND OF THE INVENTION

1. Field of the Invention

The present invention relates to a side cutter for an excavating machine of the type having a plurality of spaced digging wheels, more particularly to a pivotal cutter mounted on the side of a digging wheel to dispose of a column of material which would otherwise accumulate between the spaced digging wheels.

2. Prior Art

Excavating machines, such as U.S. Pat. No. 3,896,571 to Satterwhite, are well known in prior art. In the aforementioned patent, three spaced digging wheels are mounted on a common shaft. In practice, the wheels are spaced approximately 15 inches apart and therefore leave columns of material approximately 15 inches in width between the wheels, thus impeding the progress of the excavation. No prior art reference discloses a side cutter mounted on the side of a digging wheel employed to break up the column or columns of uncut material.

SUMMARY OF THE INVENTION

The excavating machine which utilizes the present invention has three large rotating digging wheels. Each of the digging wheels has a pair of spaced sidewalls between which are mounted a plurality of buckets. These digging wheels are mounted on a common horizontal shaft and are spaced approximately fifteen inches apart in order to provide space for the frame mountings. However, during the course of digging through brittle material such as coal, the spaced digging wheels generally leave two parallel columns of uncut material, each approximately fifteen inches wide. The columns of uncut material can bear against the frame thereby impeding the progress of the excavating machine. The columns are sometimes interfere with subsequent bulldozing operations.

The present invention provides side cutters for breaking up the columns of uncut material. These side cutters are mounted on the sidewalls of the three digging wheels adjacent to the open spaces between the wheels so as to break up the columns with cutting teeth and thus channel some of the material directly into the buckets. The present invention are particularly comprises a plurality of pivotal side cutters mounted on the inner sidewalls of the bucket wheels, a cam or deflector mounted on the forward end of the frame rails, and a plurality of curved metal strips or "wear bars" welded to the main frame which provide transitional surfaces for a roller to roll on until the pivotal side cutters clear the frame.

Prior to mounting each pivotal side cutter on a digging wheel, a section of the sidewall, adjacent to the open space between the wheels, is cut away to provide an opening in which the side cutter will be disposed. The cut-away section provides clearance for the side cutter to be moved away from the open space and into the wheel as it is deflected away from the frame and into a closed position. The side cutter remains in a closed position until it clears the frame.

The pivotal side cutter is mounted on a C-shaped base plate having a short central flange along its lower inside edge and which extends into an open central area of the base plate. The base plate is welded to the sidewall of the digging wheel along the periphery of the cut-away section so as to be adjacent the open space between the wheels.

A block comprising a rounded portion having a ledge or platform extending at a right angle therefrom, is welded to the central flange of the base plate along the side adjacent to the bucket (or inside) portion of the digging wheel. The ledge is horizontally disposed and is provided with a short central peg on its upper surface. The lower end of a compression spring is received onto the central peg.

The pivotal side cutter is comprised of a front pivotal panel and a back pivotal panel, substantially equal in size and having rounded lower ends. The panels are vertically disposed and are essentially parallel having a channel plate disposed in a vertical space therebetween. The front panel is provided with a bend along its horizontal center so that its upper end is sloped slightly toward the back panel.

The channel plate is provided with a horizontal bend along its upper end and has it sides welded to the inner surfaces of the two panels. The inner surface of the channel plate faces the space between the wheels when the pivotal side cutter is mounted on the wheel. The outer surface of the channel plate's upper curved end forms a throat leading into the bucket portion of the wheel.

The front pivotal panel is provided with a cutting tooth, affixed to the outside upper corner of this panel adjacent to the open space between the wheels. A stopping flange or limit is welded to the upper edge of the front panel adjacent to the inside of the bucket wheel.

A dowel is mounted on the front pivotal panel just below the cutting tooth and extends through the panel into the vertical space between the front and back panels. A cam follower or roller is rotatably received on the dowel. The dowel is provided with an ear-shaped support plate which is received on the dowel behind the roller. The lower end of the support plate is welded to the inner surface of the channel plate. A cotter pin is received into a suitable hole on the end of the dowel behind the support plate.

The front and back pivotal panels are disposed vertically in the open central area of the base plate having their lower ends pivotally mounted on the rounded portion of the block. The block is disposed between the front and back panels and their lower ends are pivotally mounted by means of a shaft which is received into suitable holes in the panels and blocks. The shaft provides a pivot axis for the side cutter and is secured in place by means of a cotter pin received into a suitable hole behind the back panel.

A horizontally disposed housing plate is welded to the outer surface of the channel plate adjacent to the bucket portion of the digging wheel in parallel relation with the ledge of the block. The housing plate is provided with a downwardly extending central bottom peg affixed to its lower side. The upper end of the compression spring is received onto the peg, so as to dispose the spring between the housing plate and the ledge of the block. A triangular bracket is welded to the top of the housing plate and to the outer surface of the channel plate.

A wedge-shaped doubler plate or sheath is welded to the inner surface of the sidewall of the wheels directly below the block. A triangular bracing is welded to the lower side of the block and to the sheath along the side adjacent the bucket portion of the wheel. The triangular bracing provides support for the block.

The upper portion of the base plate is provided with a stop bar or crosspiece bolted to the plate along the side adjacent to the bucket portion of the wheel. The bar extends forward toward the front panel between the cutting tooth and the stopping flange and limits the pivotal motion of the side cutter into the open space between the wheels.

A cam or deflector is mounted on the forward end of the frame rails of the excavating machine in the upper portion of the open space between the wheels. As the side cutter approaches the frame, the roller engages the deflector so that the side cutter is pushed into a closed position. The roller rolls along a wear bar which is welded to the frame until the cutter clears the frame and the action of the spring pivots the side cutter towards the open space between the wheels.

DETAILED DESCRIPTION OF THE PREFERRED EMBODIMENTS

Figure 7:
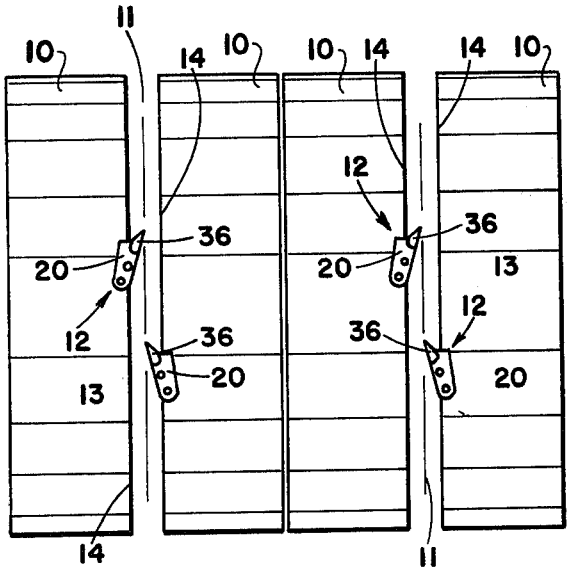
FIG. 7 is a diagrammatic illustration of a plurality of pivotal side cutters mounted on the sidewalls of the digging wheels of an excavating machine.

The present invention relates to a side cutter apparatus for an excavating machine. The excavating machine which utilizes the present invention has three large rotating digging wheels 10, as shown in FIG. 7. The digging wheels are mounted on a common shaft 13 at the front of an excavating machine, such as that disclosed in U.S. Pat. No. 3,896,571 to Satterwhite. Each digging wheel is provided with a pair of spaced sidewalls between which are mounted a plurality of buckets which can be extended and retracted as the wheels are rotated through brittle material such as coal.

The three digging wheels are separated by a space of approximately 14½ inches to provide space for frame mountings. A plurality of digging teeth are affixed to the outer edges of the buckets of each digging wheel. The teeth are forced into various types of brittle materials as the wheels rotate about their common shaft, subsequently breaking up the brittle material and channeling it into the buckets for recovery. However, during the course of digging through this brittle material often times a column of uncut material of approximately 14½ inches in width remains in the spaces between the wheels. These columns bear against the frame thereby impeding the progress of the machine. The present invention provides a means to dispose of the columns of uncut material by breaking up the column and channeling some of the material directly into the buckets of the digging wheels for subsequent recovery.

The present invention relates to a side cutter apparatus for an excavating machine, more particularly a pivotal side cutter mounted on the inner sidewalls of spaced digging wheels, as diagrammatically shown in FIGS. 7 and 8 of the drawings, and to be described in greater detail hereinafter.

Figure 1:
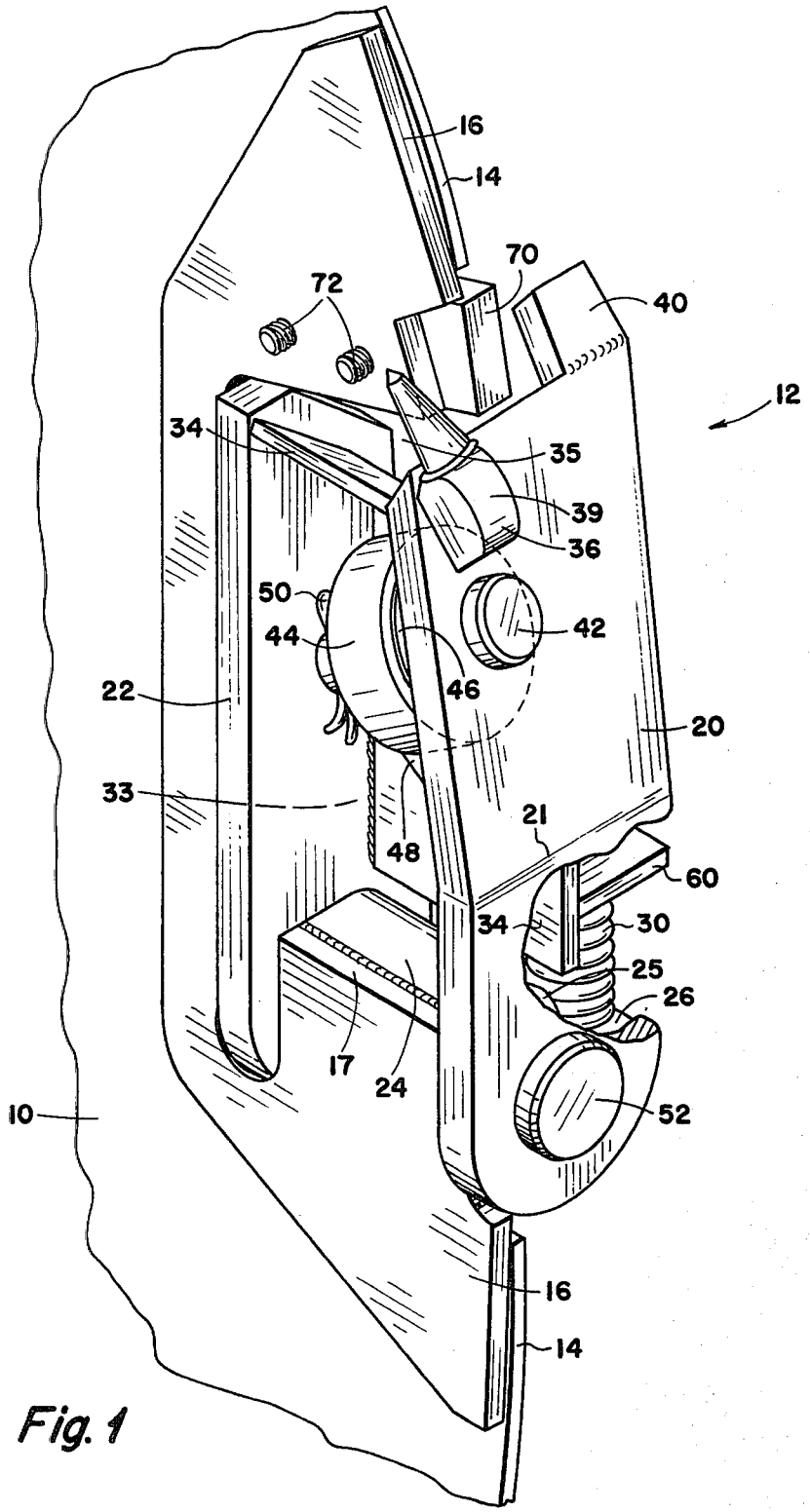
FIG. 1 is an isometric view of the pivotal side cutter of the present invention.

Referring to the drawings in greater detail, the pivotal side cutter 12 of the present invention is shown in FIG. 1 as mounted on a portion of the sidewall 14 of a digging wheel 10 adjacent to the space 11 (see FIG. 7) between the wheels. Prior to the installation of side cutter 12, a cut-away section 15 is provided in sidewall 14. Pivotal side cutter 12 is comprised of a base plate 16 welded to sidewall 14, a front pivotal panel 20 and a back pivotal panel 22 which are pivotally mounted at their lower ends on a block 24 disposed therebetween; the details of which will be described hereinafter.

Figure 2:
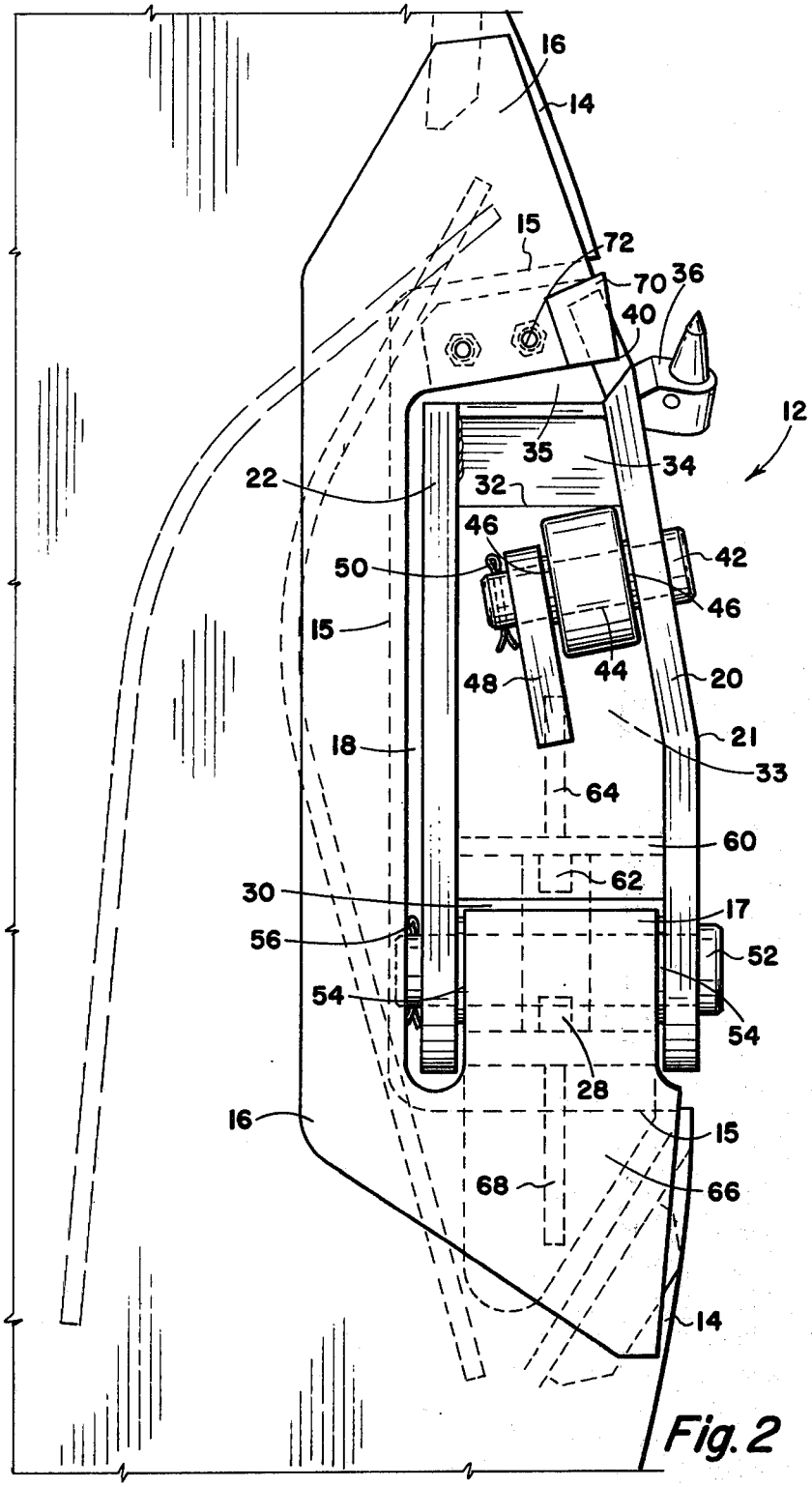
FIG. 2 is a side elevational view of the pivotal side cutter with certain hidden parts being shown in broken lines.

As shown in FIG. 2, base plate 165 is approximately C-shaped and has a short lower central flange 17 extending into its open central area 18. Base plate 16 is welded to sidewall 14 along the periphery of the cut-away section 15 of the sidewall at the side adjacent to space 11 between the digging wheels. The cut-away section allows for lateral pivotal movement of side cutter 12 away from its respective sidewall 14 into space 11.

Figure 3:
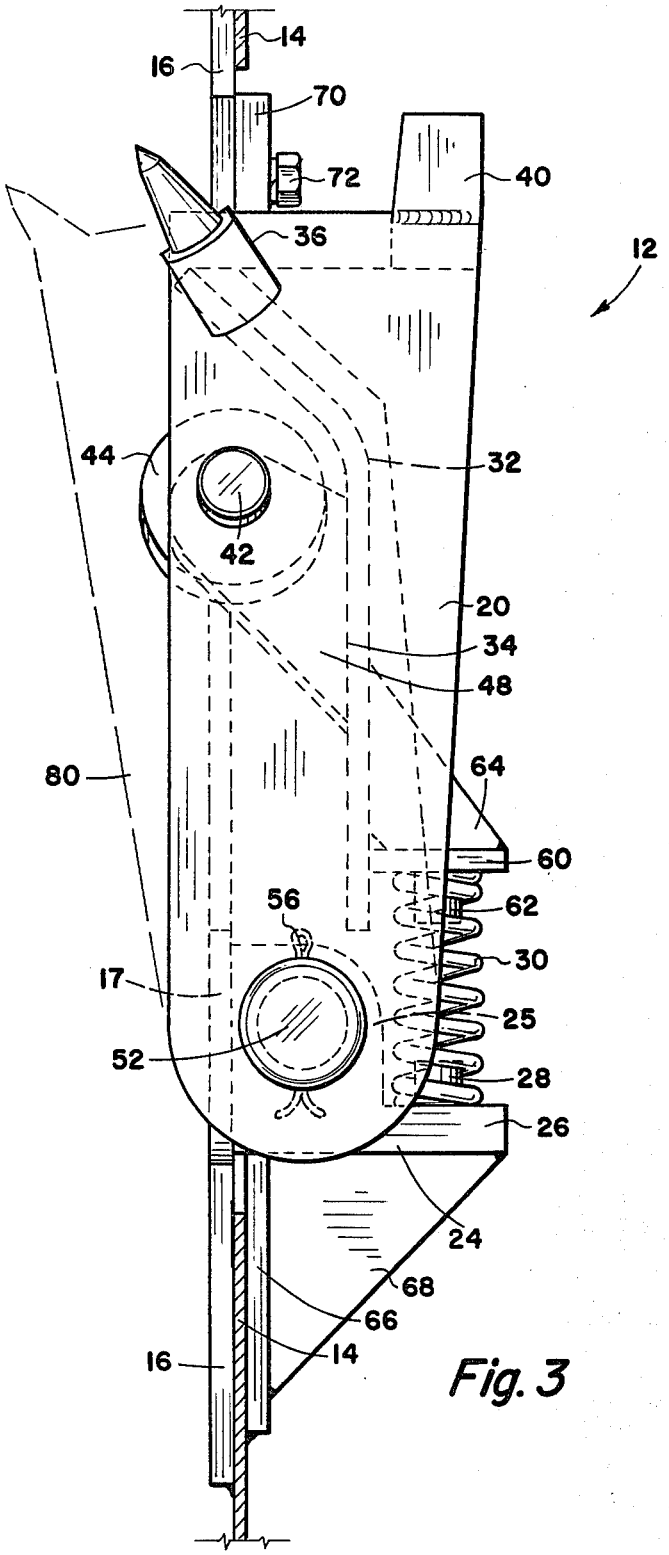
FIG. 3 is a front elevational view of the pivotal side cutter with certain hidden parts being shown in broken lines.

Referring to FIG. 3, block 24 comprises a rounded portion 25 (shown in dotted lines) and a horizontally disposed ledge 26 extending at a right angle therefrom. Block 24 is welded to central flange 17 of base plate 16 along the side adjacent to the bucket or inside portion of the digging wheel. Ledge 26 of block 24 is provided with an upwardly extending central peg 28 on its upper surface. The lower end of a compression spring 30 is received on central peg 28.

Referring again to FIG. 1, front pivotal panel 20 and back pivotal panel 22 are shown to be substantially equal in size and having rounded lower ends. Pivotal panels 20 and 22 are vertically disposed in essentially parallel relation, providing a vertical space 33 therebetween. Front panel 20 is provided with a horizontal bend 21 along its center so that its upper end is slightly sloped toward back panel 22 and so that it will more closely conform to the outer periphery of the sidewall 14. The front panel is disposed radially outwardly from the back panel with respect to the shaft 13. A channel plate 34 is disposed in vertical space 33 so as to be adjacent to the bucket portion of the wheel. Channel plate 34 is provided with a horizontal bend 32 along its upper end and its sides are welded to the inner surfaces of panels 20 and 22. The inner surface of channel plate 34 faces the space between the wheels so that the upper outer surface of the plate forms a throat or channel 35 with the pivotal panels 20 and 22 and with the upper end of the cut-away section 15 leading into the bucket portion of the wheel.

A cutting tooth 36 is affixed to the upper corner of front panel 20 adjacent to space 11 and is disposed at an angle so as to extend into space 11. A stopping flange 40 is welded to the upper edge of the front panel on the opposite corner from tooth 36 and adjacent to the inside portion of the bucket wheel.

Returning to FIG. 2, a dowel 42 is mounted on front pivotal panel 20, in essentially perpendicular relation to the bent portion thereof below cutting tooth 36 and extending through panel 20 into vertical space 33. A cam follower or roller 44 is rotatably received on dowel 42 so as to be directly adjacent to space 11 and is interposed between two washers 46. An ear-shaped support plate 48 is received on dowel 42 behind roller 44. The straight side of support plate 48 is welded to the inner surface of channel plate 34. A cotter pin 50 is received in the end of the dowel 42 to the left of the support plate to further secure the roller and the dowel in position.

Front and back pivotal panels 20 and 22 have their lower ends pivotally mounted on rounded portion 25 of block 24 by means of a shaft 52 which is received into drilled holes in the panels and block 24. Two washers 54 are received on shaft 52 between block 24 and the lower ends of panels 20 and 22. Shaft 52 provides a common pivot axis for the panels and is secured in place by means of a cotter pin 56, received in shaft 52 behind back panel 22.

A horizontally disposed housing plate 60, shown in FIG. 3, is welded to the outer surface of channel plate 34 adjacent to the bucket portion of the wheel and is parallel to ledge 26 of block 24. Housing plate 60 is provided with a downwardly extending central peg 62 affixed to its lower surface. The upper end of compression spring 30 is received onto peg 62 thereby disposing spring 30 between housing plate 60 and ledge 26 of block 24. A triangular bracket 64 is welded to the upper surface of housing plate 60 and to the side channel plate 34 and provides retaining support for housing plate 60.

Figure 4:
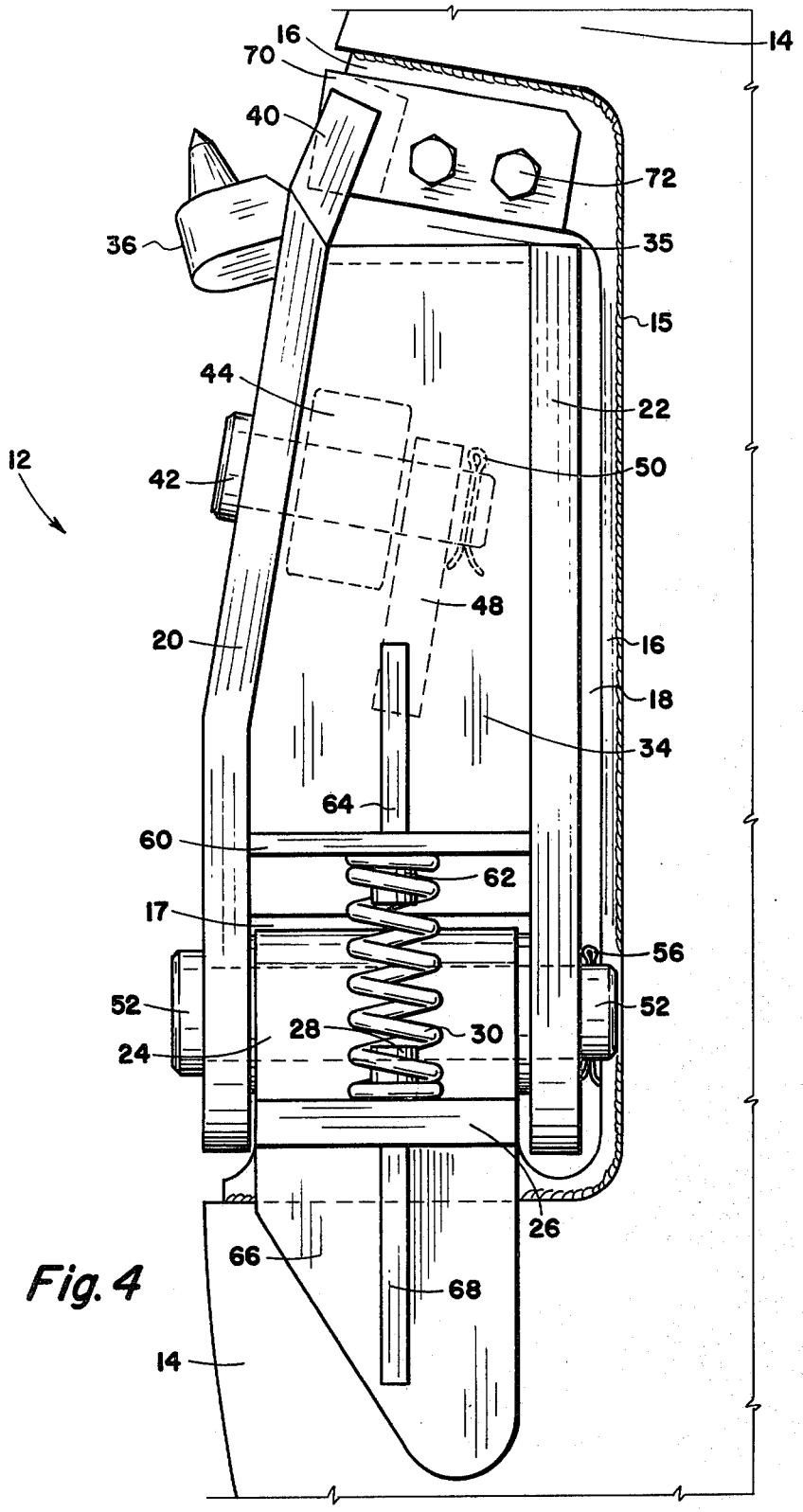
FIG. 4 is a side elevational view of the pivotal side cutter as viewed from the inside of a digging wheel with certain hidden parts being shown in broken lines.

As shown in FIG. 4, a wedge-shaped doubler plate or sheath 66 is welded to the inner surface of sidewall 14 directly below block 24. A triangular brace 68 (see FIG. 3) is welded to the lower side of block 24 and to sheath 66 along the side adjacent to the bucket portion of the wheel. Triangular brace 68 provides support for the block.

As best shown in FIG. 1, the upper portion of base plate 16 is provided with a stop bar or crosspiece 70 affixed to base plate 16 by means of two cap screws 72 along the side adjacent to the bucket portion of the wheel. Stop bar 70 extends forward toward front panel 20 between cutting tooth 36 and stopping flange 40 and limits the pivotal movement of side cutter 12 into space 11.

The action of the compression spring normally urges side cutter 12 away from sidewall 14 and into the space between the wheels by pivoting along shaft 52 into an open or extended position, shown as dashed line 80 in FIG. 2. The pivotal motion into the space or the column of uncut material is limited by stopping flange 40 resting against stop bar 70.

Figure 5:
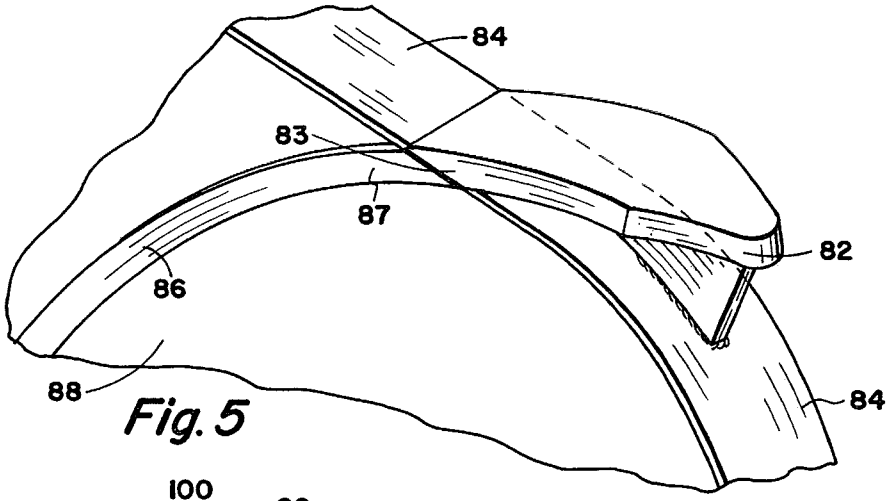
FIG. 5 is an isometric view of the deflector of the present invention.

FIG. 5 shows a cam or V-shaped deflector 82 mounted on the forward portion of a frame rail 84. A plurality of curved metal strips or "wear bars" 86 are welded along the inside of the frame portion 88 which is part of the frame of the overall machine extending between the wheels which is welded to frame portion 88. Upper ends 87 of wear bars 86 are flush with lower ends 83 of deflector 82. Deflector 82 represents the top of an arc formed by rotating the digging wheels about their common shaft 13. Wear bars 86 are affixed to the inside of frame 88 along the arc beneath frame rail 84.

Figure 6:
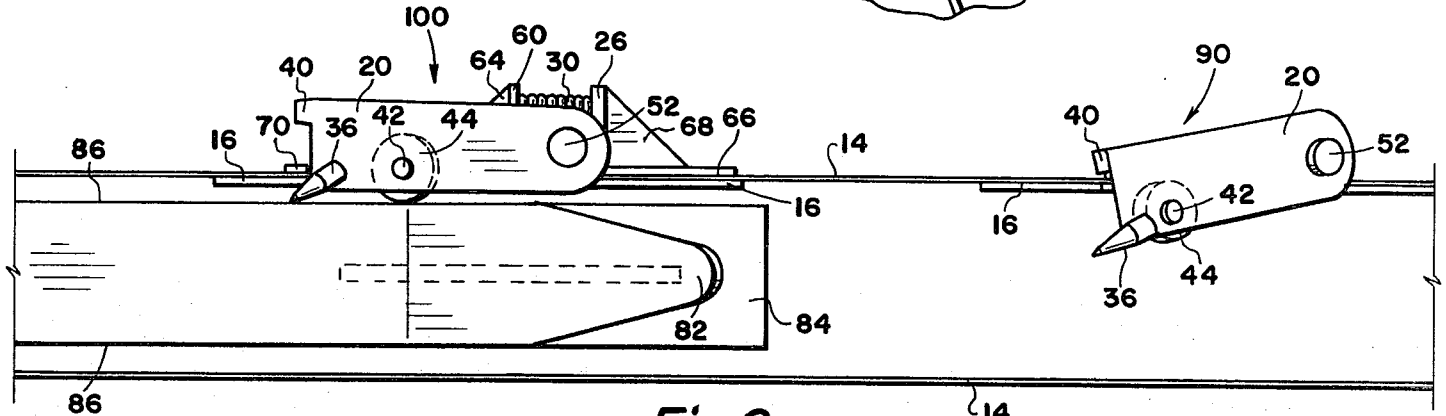
FIG. 6 is a top plan view of the deflector and two pivotal side cutters.
Figure 8:
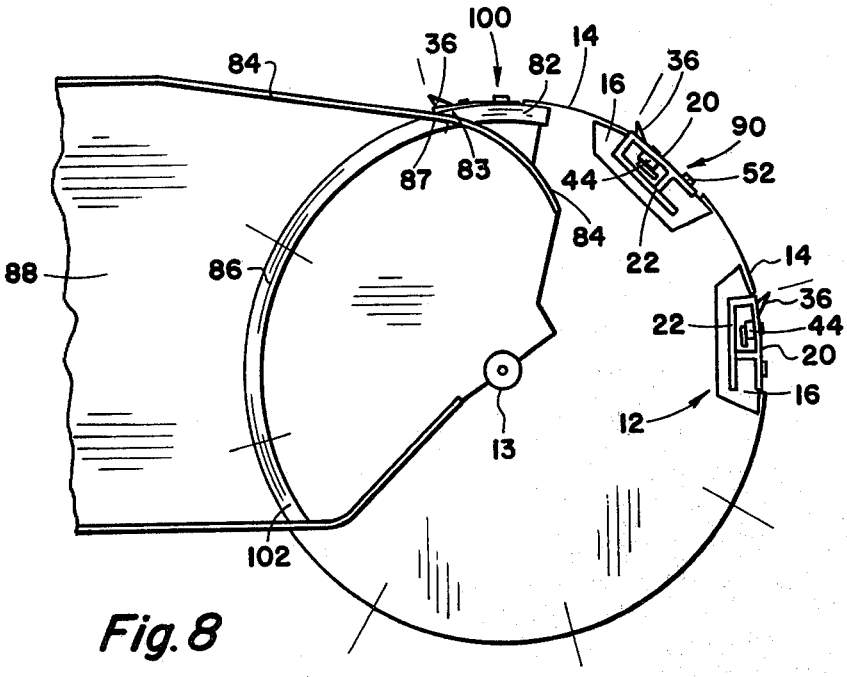
FIG. 8 is a side elevational view of a digging wheel mounted on the subframe of an excavating machine having a plurality of pivotal side cutters mounted on its sidewall.

Referring to FIGS. 6 and 8, a typical cycle of a rotating bucket wheel starts with side cutter 12 in an open position near the top of the arc as shown by position 90. As side cutter 12 approaches frame rail 84, roller 44 contacts deflector 82 which pushes the side cutter into a closed position 100 inside the bucket portion of the wheel allowing it to pass by frame 88. Roller 44 then contacts wear bar 86 which provides a transitional area for roller 44 thereby keeping side cutter 12 closed until it has completely cleared frame 88. After side cutter 12 has cleared frame 88 at point 102 (see FIG. 8), the action of compression spring 30 initially opens the side cutter into the column of brittle material. The angle of cutting tooth 36 as it is forced into the column, keeps side cutter 12 in an open position.

Figure 9:
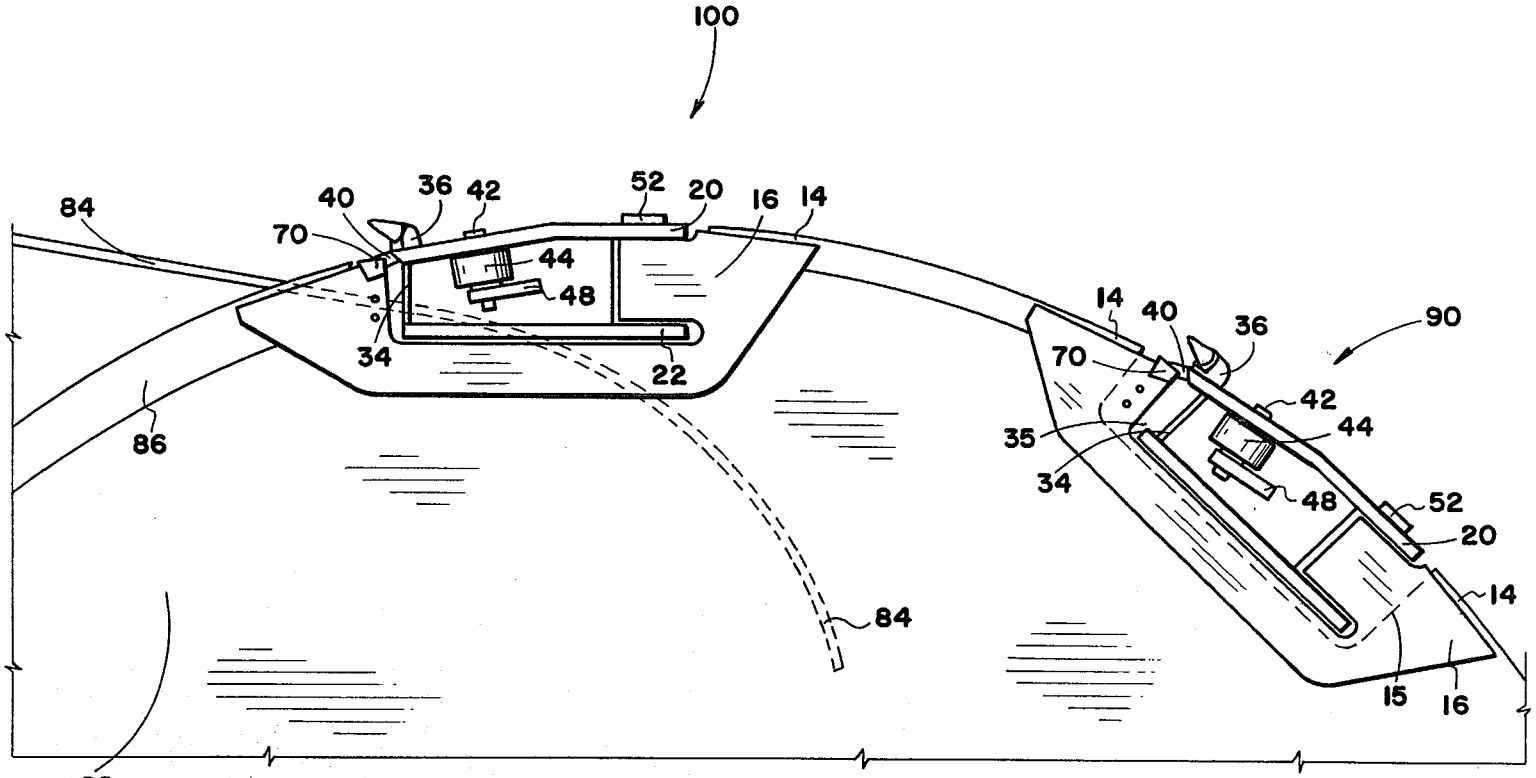
FIG. 9 is an enlarged fragmentary view of a portion of FIG. 8 with the side cutters in a slightly advanced position.

Side cutter 12 disposes of the column of brittle material in space 11 by breaking up the column with cutting tooth 36 as the side cutter proceeds around the arc. Some of the material is channeled into the bucket of the digging wheel through throat 35 of channel plate 34. The remainder of the loose material will flow into the space between the wheels to be picked up by the next side cutter or it will flow into an area where the buckets of the wheels can pick it up. As the side cutter approaches the top of the arc (see FIG. 9), it is ready to be closed and clear the frame.

Whereas the present invention has been described in particular relation to the drawings attached hereto, it should be understood that other and further modifications, apart from those shown or suggested herein, may be made within the spirit and scope of this invention.

What is claimed is:

1. A side cutter apparatus for an excavating machine of the type having a plurality of spaced rotating digging wheels mounted on a common shaft of a frame, each wheel having a pair of spaced sidewalls and a plurality of buckets mounted therebetween, and having frame rails partially extending into the spaces between the sidewalls of adjacent digging wheels; which comprises a base plate affixed to the periphery of a cut-away section of a sidewall adjacent to the open space between said sidewall and that of the adjacent wheel, a pivotal side cutter formed by a pair of essentially parallel front and back panels, said back panel disposed in said cut-away section and being pivotally mounted at its lower end so as to pivot away from its respective sidewall and into said open space, said front panel being pivotally mounted at its lower end on a common axis with said back panel so as to be pivotally movable therewith, said front panel being disposed radially outward from said back panel with respects to said common shaft of said digging wheels, a cutting tooth affixed to an upper portion of said front panel adjacent to the said open space and being disposed at an angle so as to extend into said open space, a roller rotatably mounted on said front panel on an axis extending into a vertical space between said panels so as to dispose said roller directly adjacent to said open space, resilient means for providing pivotal movement of said pivotal side cutter into said open space; means for limiting said pivotal movement of said pivotal side cutter into said open space; means for urging said pivotal side cutter into a closed position inside a bucket of said digging wheel; and means for maintaining said pivotal side cutter in said closed position thereby allowing said pivotal side cutter to clear said frame of said excavating machine as the digging wheels rotate about said common shaft.

2. A side cutter apparatus as set forth in claim 1 and including a channel plate disposed in said vertical space between said front panel and said back panel adjacent to said bucket of said wheel, said channel plate being affixed to the inner surface of said panels and having its upper end bent so as to slope toward said open space thereby providing a throat along its upper end leading into said bucket of said wheel.

3. A side cutter apparatus as set forth in claim 2 and being further characterized by said base plate being approximately C-shaped and having a lower central flange extending into said cut-away section and including a block having a rounded portion affixed to said central flange of said base plate thus providing means for pivotally mounting the lower ends of said panels wherein said rounded portion is disposed therebetween.

4. A side cutter apparatus as set forth in claim 3 wherein said resilient means for providing pivotal movement comprises a horizontal ledge extending at a right angle from said rounded portion of said block into said bucket of said wheel, a horizontally disposed parallelly spaced housing plate affixed to a portion of said channel plate adjacent said bucket, and a compression spring disposed between said ledge and said housing plate.

5. A side cutter apparatus as set forth in claim 1 wherein said means for limiting said pivotal movement comprises a stopping flange affixed to the upper edge of said front panel adjacent to said bucket of said wheel and a bar affixed to an upper portion of said base plate and extending outwardly toward said front plate so that its outer end is disposed between said cutting tooth and said stopping flange.

6. A side cutter apparatus as set forth in claim 1 and being further characterized by a plurality of spaced pivotal side cutters mounted radially on the sidewall of each said digging wheel adjacent to said open space.

7. A side cutter apparatus as set forth in claim 6 wherein said means for urging said pivotal side cutters into a closed position comprises a plurality of V-shaped deflectors mounted on the forward portion of the frame rails radially above said common shaft so as to contact said roller at the top of an arc formed by rotating said digging wheels about the common axis of said shaft.

8. A side cutter apparatus as set forth in claim 7 wherein said means for maintaining said pivotal side cutters in said closed position comprises a plurality of curved metal strips affixed to said frame below said frame rails and along said arc formed by rotating said wheels and having their upper ends directly adjacent said deflectors.

* * * * *